US006752673B2

(12) United States Patent
Nakata et al.

(10) Patent No.: US 6,752,673 B2
(45) Date of Patent: Jun. 22, 2004

(54) COOLING ARRANGEMENT FOR OUTBOARD MOTOR

(75) Inventors: Jun Nakata, Shizuoka (JP); Toshiaki Sato, Shizuoka (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 32 days.

(21) Appl. No.: 10/170,767

(22) Filed: Jun. 11, 2002

(65) Prior Publication Data

US 2002/0197920 A1 Dec. 26, 2002

(30) Foreign Application Priority Data

Jun. 20, 2001 (JP) ..... 2001-186404

(51) Int. Cl.[7] ..... B63H 21/38
(52) U.S. Cl. ..... 440/88 K
(58) Field of Search ..... 440/88 R, 88 C, 440/88 D, 88 G, 88 J, 88 K, 88 M, 88 HE, 88 P, 89 B, 89 C, 89 D

(56) References Cited

U.S. PATENT DOCUMENTS

| | | | |
|---|---|---|---|
| 3,310,022 | A | 3/1967 | Kollman |
| 3,350,879 | A | 11/1967 | Boda et al. |
| 4,421,490 | A | 12/1983 | Nakahama |
| 4,523,556 | A | 6/1985 | Suzuki |
| 5,036,804 | A | 8/1991 | Shibata |
| 5,118,316 | A | 6/1992 | Kakizaki et al. |
| 5,232,387 | A | 8/1993 | Sumigawa |
| 5,487,688 | A | 1/1996 | Sumigawa |
| 5,595,515 | A | 1/1997 | Hasegawa et al. |
| 5,733,157 | A | 3/1998 | Okuzawa et al. |
| 5,769,038 | A | 6/1998 | Takahashi et al. |
| 5,816,208 | A | 10/1998 | Kimura |
| 5,924,901 | A | 7/1999 | Takahashi et al. |
| 5,934,960 | A | 8/1999 | Katayama et al. |
| 6,027,385 | A | 2/2000 | Katayama et al. |
| 2001/0044245 | A1 | 11/2001 | Nakata et al. |
| 2002/0002019 | A1 | 1/2002 | Nakata et al. |

OTHER PUBLICATIONS

Co–pending patent application: Ser. No. 09/303,066, filed Apr. 30, 1999, entitled Exhaust Arrangement for Outboard Motor, in the name of Tsunekawa et al., and assigned to Sanshin Kogyo Kabushiki Kaisha.

Co–pending patent application: Ser. No. 09/440,777, filed Nov. 16, 1999, entitled Outboard Motor Cooling System, in the name of Toshihiro Nozue, and assigned to Sanshin Kogyo Kabushiki Kaisha.

Co–pending patent application: Ser. No. 10/106,525, filed Mar. 25, 2002, entitled Cooling Arrangement for Outboard Motor, in the name of Shibata et al., and assigned to Sanshin Kogyo Kabushiki Kaisha.

*Primary Examiner*—Jesus D. Sotelo
(74) *Attorney, Agent, or Firm*—Knobbe, Martens, Olson & Bear, LLP.

(57) ABSTRACT

An outboard motor includes a housing unit that forms an outer wall exposed outside. An engine is disposed above the housing unit. The engine defines a water jacket. A water transfer system is arranged to introduce water from outside of the housing unit to deliver the water to the water jacket and to discharge the water to a location out of the housing unit. The water transfer system includes first and second water passages defined within the housing unit. The first water passage communicates with the water jacket. The second water passage does not communicate with the water jacket. The water transfer system delivers a portion of the water to the second water passage upstream of the water jacket. The second water passage extends next to the outer wall. The first water passage is spaced apart from the outer wall by the second water passage.

24 Claims, 11 Drawing Sheets

COOLING ARRANGEMENT FOR OUTBOARD MOTOR

PRIORITY INFORMATION

This application is based on and claims priority to Japanese Patent Application No. 2001-186404, filed Jun. 20, 2001, the entire contents of which is hereby expressly incorporated by reference.

BACKGROUND OF THE INVENTION

1. Field of the Invention

This invention relates generally to a cooling arrangement for an outboard motor, and more particularly to an improved cooling arrangement for discharging coolant that has circulated through an engine of an outboard motor.

2. Description of Related Art

An outboard motor typically includes a housing unit that can be mounted on an associated watercraft and an internal combustion engine disposed above the housing unit. The housing unit carries a propulsion device such as, for example, a propeller to propel the watercraft. The engine powers the propulsion device with a driveshaft and a propulsion shaft extending through the housing unit.

The engine builds heat because air/fuel charges are combusted in the combustion chamber(s) of the engine. Typically, the outboard motor has a cooling system which draws water from a body of water surrounding the outboard motor to the engine and discharges the water to a location out of the outboard motor. The housing unit defines delivery and discharge passages of the cooling system.

In typical arrangements, the discharge passage can extend next to an outer wall of the housing unit. The water that has traveled through the engine flows through the discharge passage. The water, however, can be hot and the outer wall of the housing unit thus can be heated with the hot water. In the meantime, the outboard motor is quite often utilized at sea and salt components, particularly calcium (Ca), can adhere to the outer surface of the wall. Calcium is apt to become white when heated. The outer wall with the whitened calcium detracts from the appearance of the outboard motor.

SUMMARY OF THE INVENTION

A need therefore exists for an improved cooling arrangement for an outboard motor that can inhibit the outer wall of a housing unit from becoming white and thereby maintain the good appearance of the outboard motor.

In accordance with one aspect of the present invention, an outboard motor comprises a housing unit adapted to be mounted on an associated watercraft. The housing unit at least in part forms an outer wall exposed outside. An internal combustion engine is disposed above the housing unit. The engine defines a coolant jacket through which engine coolant passes. The housing unit defines first and second coolant passages. The first coolant passage is spaced apart from the outer wall. The first coolant passage communicates with the coolant jacket to allow the engine coolant to flow therethrough. The second coolant passage extends adjacent to the outer wall. The second coolant passage does not communicate with the coolant jacket and allows coolant that has not passed through the coolant jacket to flow therethrough.

In accordance with another aspect of the present invention, an outboard motor comprises a housing unit adapted to be mounted on an associated watercraft. The housing unit at least in part forms an outer wall exposed outside. An internal combustion engine is disposed above the housing unit. The engine defines a water jacket. A cooling system is configured to introduce water from outside of the housing unit to deliver the water to the water jacket and to discharge the water to a location out of the housing unit. The cooling system includes first and second water passages defined within the housing unit. The first water passage communicates with the water jacket. The second water passage does not communicate with the water jacket. The water transfer system delivers a portion of the water to the second water passage upstream of the water jacket. The second water passage extends next to the outer wall. The first water passage is spaced apart from the outer wall by the second water passage.

In accordance with a further aspect of the present invention, an outboard motor comprises a housing unit adapted to be mounted on an associated watercraft. The housing unit at least in part forms an outer wall exposed outside. An internal combustion engine is disposed above the housing unit. The engine defines a coolant jacket. The housing unit defines an internal exhaust passage communicating with an exhaust port of the engine to discharge exhaust gases from the engine to a location out of the housing unit. The exhaust passage is spaced apart from the outer wall. A cooling system is arranged to deliver coolant to the coolant jacket and to discharge the coolant from the coolant jacket. The cooling system includes first and second coolant passages defined within the housing unit. The first coolant passage communicates with the coolant jacket. The second coolant passage does not communicate with the coolant jacket. The cooling system delivers a portion of the coolant to the second coolant passage upstream of the coolant jacket. The second coolant passage extends next to the outer wall. The first coolant passage at least in part is defined in common with the exhaust passage.

BRIEF DESCRIPTION OF THE DRAWINGS

These and other features, aspects and advantages of the present invention will now be described with reference to the drawings of a preferred embodiment, which is intended to illustrate and not to limit the invention. The drawings comprise eleven figures.

DETAILED DESCRIPTION OF THE PREFERRED EMBODIMENT OF THE INVENTION

Figure 1:
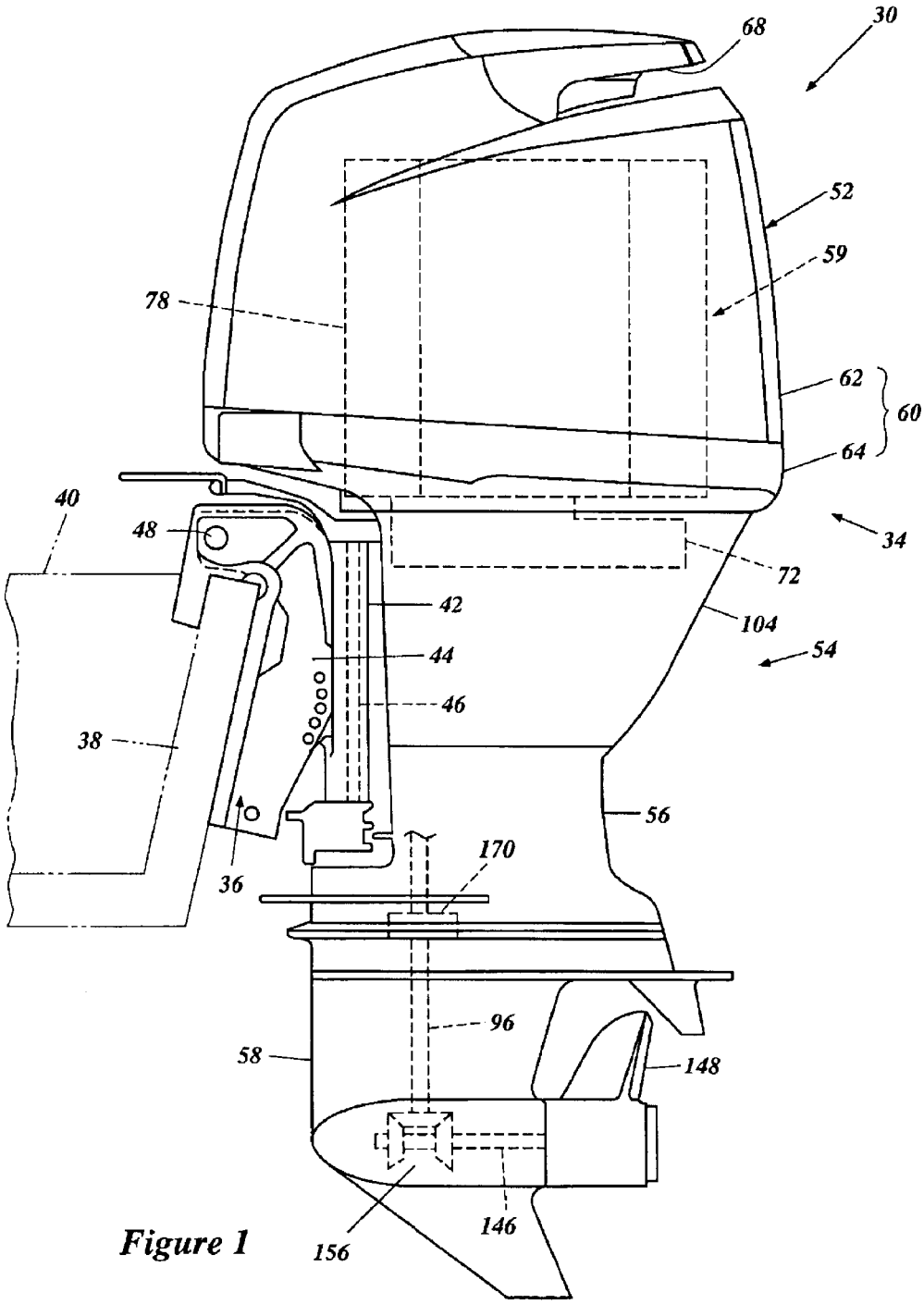
FIG. 1 is a side elevational view of an outboard motor configured in accordance with a preferred embodiment of the present invention. An associated watercraft is shown in phantom.
Figure 2:
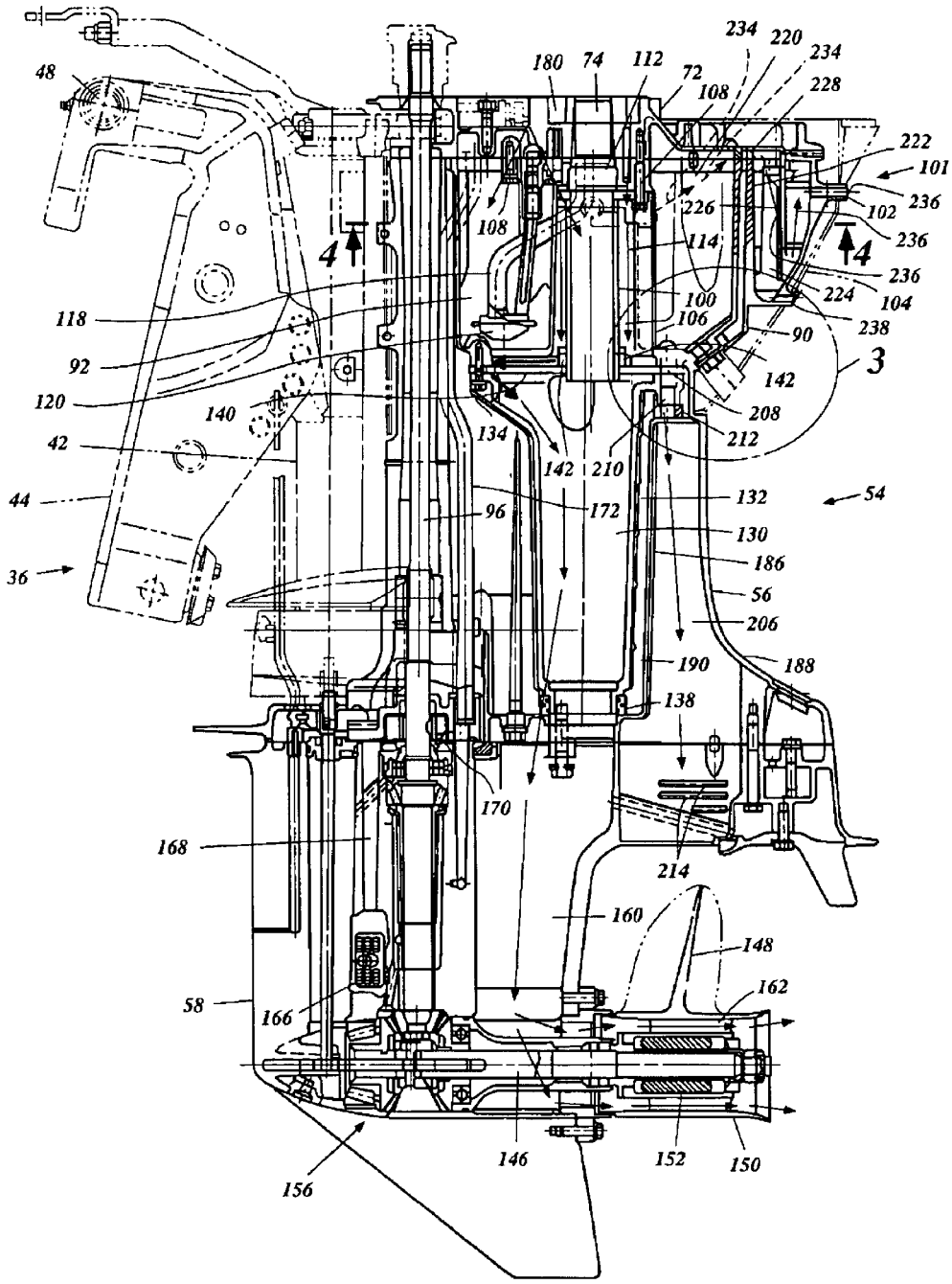
FIG. 2 is a side elevational, sectional view of a housing unit of the outboard motor. An exhaust guide member and a bracket assembly are also illustrated with the housing unit. The arrows indicate a flow of cooling water.

With particular reference to FIGS. 1 and 2, an overall construction of an outboard motor 30 configured in accordance with certain features, aspects and advantages of the present invention is described below.

In the illustrated arrangement, the outboard motor 30 comprises a drive unit 34 and a bracket assembly 36. The bracket assembly 36 supports the drive unit 34 on a transom 38 of an associated watercraft 40 and places a marine propulsion device in a submerged position with the watercraft 40 resting on the surface of a body of water. The bracket assembly 36 preferably comprises a swivel bracket 42, a clamping bracket 44, a steering shaft 46 and a pivot pin 48.

The steering shaft 46 typically extends through the swivel bracket 42 and is affixed to the drive unit 34 with upper and lower mount assemblies. The steering shaft 46 is pivotally journaled for steering movement about a generally vertically extending steering axis defined within the swivel bracket 42. The clamping bracket 44 comprises a pair of bracket arms that are spaced apart from each other and that are affixed to the watercraft transom 38. The pivot pin 48 completes a hinge coupling between the swivel bracket 42 and the clamping bracket 44. The pivot pin 48 extends through the bracket arms so that the clamping bracket 44 supports the swivel bracket 42 for pivotal movement about a generally horizontally extending tilt axis defined by the pivot pin 48. The drive unit 34 thus can be tilted or trimmed about the tilt axis.

As used through this description, the terms "forward," "forwardly" and "front" mean at or to the side where the bracket assembly 36 is located, and the terms "rear," "reverse," "backwardly" and "rearwardly" mean at or to the opposite side of the front side, unless indicated otherwise or otherwise readily apparent from the context use.

A hydraulic tilt and trim adjustment system preferably is provided between the swivel bracket 42 and the clamping bracket 44 to tilt (raise or lower) the swivel bracket 42 and the drive unit 34 relative to the clamping bracket 44. Otherwise, the outboard motor 30 can have a manually operated system for tilting the drive unit 34. Typically, the term "tilt movement," when used in a broad sense, comprises both a tilt movement and a trim adjustment movement.

The illustrated drive unit 34 comprises a power head 52 and a housing unit 54 which includes a driveshaft housing 56 and a lower unit 58. The power head 52 is disposed atop the drive unit 34 and houses an internal combustion engine 59 that is positioned within a protective cowling 60. Preferably, the protective cowling 60 defines a generally closed cavity in which the engine 59 is disposed. The protective cowling 60 preferably comprises a top cowling member 62 and a bottom cowling member 64. The top cowling member 62 preferably is detachably affixed to the bottom cowling member 64 by a coupling mechanism so that a user, operator, mechanic or repairperson can access the engine 59 for maintenance or for other purposes.

The top cowling member 62 preferably defines at least one air intake opening 68 and at least one air duct disposed on its rear and top portion. Ambient air is drawn into the closed cavity through the opening 68 and then through the duct. Typically, the top cowling member 60 tapers in girth toward its top surface, which is in the general proximity of the air intake opening 68.

The bottom cowling member 64 preferably has an opening at its bottom portion through which an upper portion of an exhaust guide member 72 extends. The exhaust guide member 72 preferably is made of an aluminum based alloy and is affixed atop the driveshaft housing 56. In other words, the exhaust guide member 72 is mounted on the driveshaft housing 56. The bottom cowling member 64 and the exhaust guide member 72 together generally form a tray. The engine 59 is placed onto this tray and is affixed to the exhaust guide member 72. In other words, the exhaust guide member 72 supports the engine 59. The exhaust guide member 72 also defines an exhaust passage 74 through which burnt charges (e.g., exhaust gases) from the engine 59 are discharged.

Figure 11:
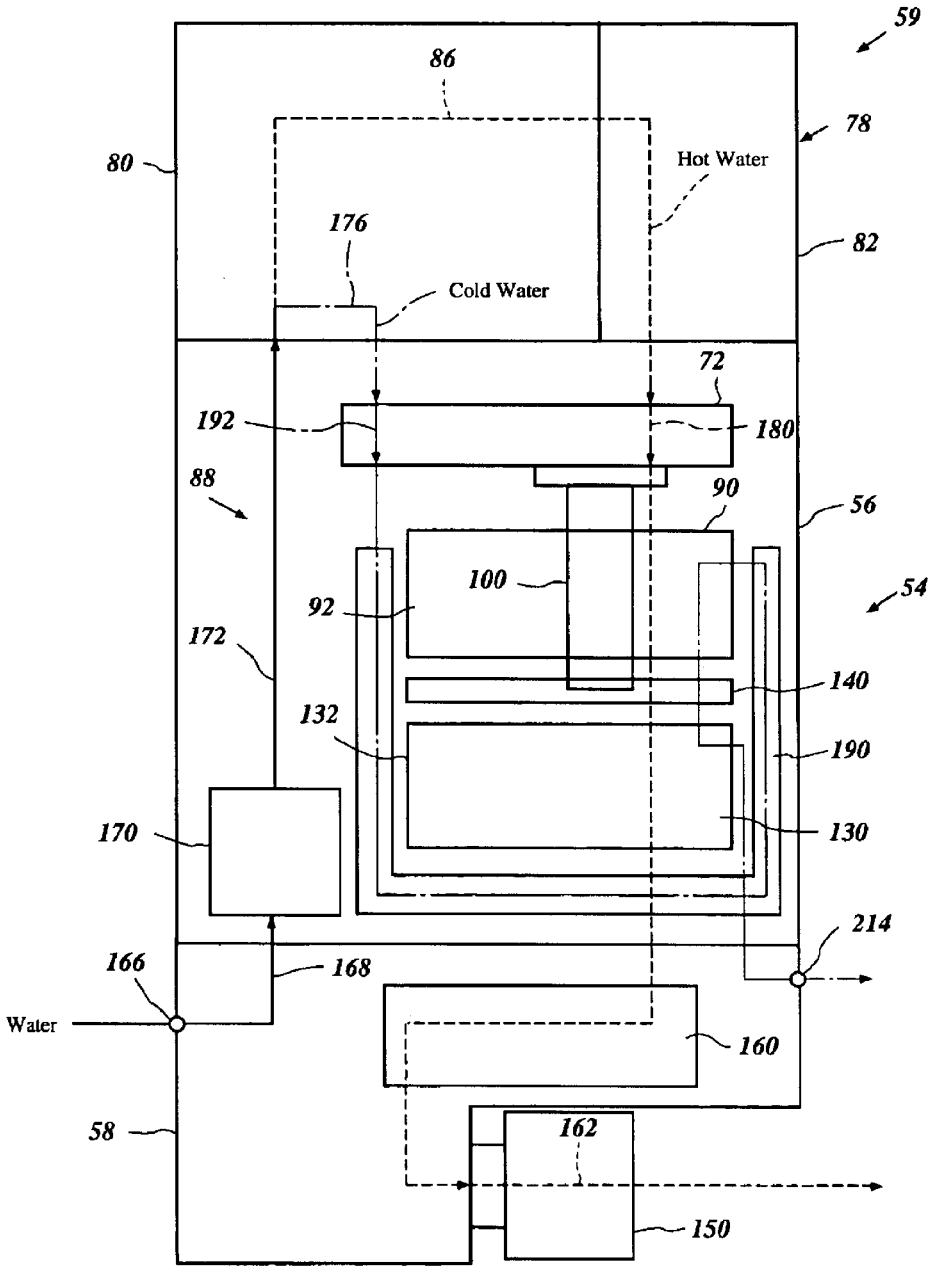
FIG. 11 is a diagrammatic view of a cooling system of the outboard motor.

With particular reference to FIG. 11, the engine 59 in the illustrated embodiment operates on a four-cycle combustion principle. This type of engine, however, merely exemplifies one type of engine. Engines operating on other combustion principles (e.g., crankcase compression two-stroke or rotary) can be employed. Engines can have any numbers of cylinders, any cylinder arrangements (In-line, V-configuration or opposing). Regardless of any particular construction, the engine 59 comprises an engine body 78.

The engine body 78 preferably comprises a cylinder block 80, a cylinder head assembly 82 and a crankcase member (not shown). The cylinder block 80 defines one or more cylinder bores in which pistons reciprocate. The cylinder head assembly 82 is affixed to the cylinder block 80 to define combustion chambers with the cylinder bores and the pistons. The crankcase member is affixed to the cylinder block 80 opposite to the cylinder head assembly 82 to define a crankcase chamber. A crankshaft (not shown) is journaled for ratation in the crankcase chamber and is connected with the pistons. The crankshaft thus is rotated with the pistons reciprocating.

The engine 59 preferably comprises an air intake system, a fuel supply system, an ignition system, and an exhaust system. The air intake system draws air from within the cavity of the cowling assembly 60 to the combustion chambers. The fuel supply system supplies fuel to the combustion chambers. Various fuel supply systems such as, for example, fuel injection systems and carburetors can be applied. The ignition system fires air/fuel charges formed by the air intake system and the fuel supply system in the combustion, chambers at proper timings. Burnt charges, i.e., exhaust gases are routed by the exhaust system.

The engine body 78 defines inner exhaust passages connected to the combustion chambers. An exhaust manifold is connected to the inner exhaust passages to collect exhaust gases coming from the respective exhaust passages. The exhaust manifold defines an exhaust port of the engine and is connected to the exhaust passage 74 of the exhaust guide member 72.

The engine 59 generates significant heat during the operation. In order to cool the engine body 78, a water jacket 86 preferably is defined within the engine body 78. A cooling water transfer system 88 forms a part of the cooling system and is provided to deliver cooling water to the water jacket 86 and to discharge the water from the water jacket 86. Preferably, an open loop system is applied as the water transfer system 88, described in greater detail below.

The engine 59 preferably comprises a lubrication system to deliver lubricant oil to engine portions that need lubrication. Where a four-stroke internal combustion engine is used as the engine 59, a closed-loop lubrication system preferably is employed.

The lubrication system comprises at least one lubricant passage defined within the engine body 78 and a lubricant reservoir member 90. The reservoir member 90 is disposed below the engine 59 within the driveshaft housing 56 to define a lubricant reservoir 92. Lubricant oil is supplied from the lubricant reservoir 92 to the engine portions and then the lubricant oil returns back to the reservoir 92.

With particular reference to FIGS. 1 and 2, the driveshaft housing 56 is positioned below the exhaust guide member 72. A driveshaft 96 preferably extends generally vertically through an opening formed at forward portions of the engine body 78, the exhaust guide member 72 and the driveshaft housing 56 to be coupled with the crankshaft at a bottom portion of the engine body 78. The driveshaft 96 is journaled for rotation in the driveshaft housing 56 and is driven by the crankshaft.

The driveshaft housing 56 defines internal exhaust sections. A first exhaust conduit 100 forms one of the exhaust sections. The exhaust conduit 100 defines an exhaust passage that is coupled with the exhaust passage 74 of the exhaust guide member 72 to convey the exhaust gases to other downstream exhaust sections disposed downstream.

The internal exhaust section includes an idle discharge section 101 that is branched off from the downstream exhaust sections to discharge exhaust gases to the atmosphere under idle operation of the engine 59. A relatively small idle exhaust discharge port 102 preferably is opened at an upper rear portion of the driveshaft housing 56.

An apron 104 covers an upper portion of the driveshaft housing 56 and the exhaust guide member 72 to improve appearance of the housing unit 54. The apron 104 has openings through which at least the exhaust discharge port 102 can communicate with the exterior of the apron 104.

Figure 3:
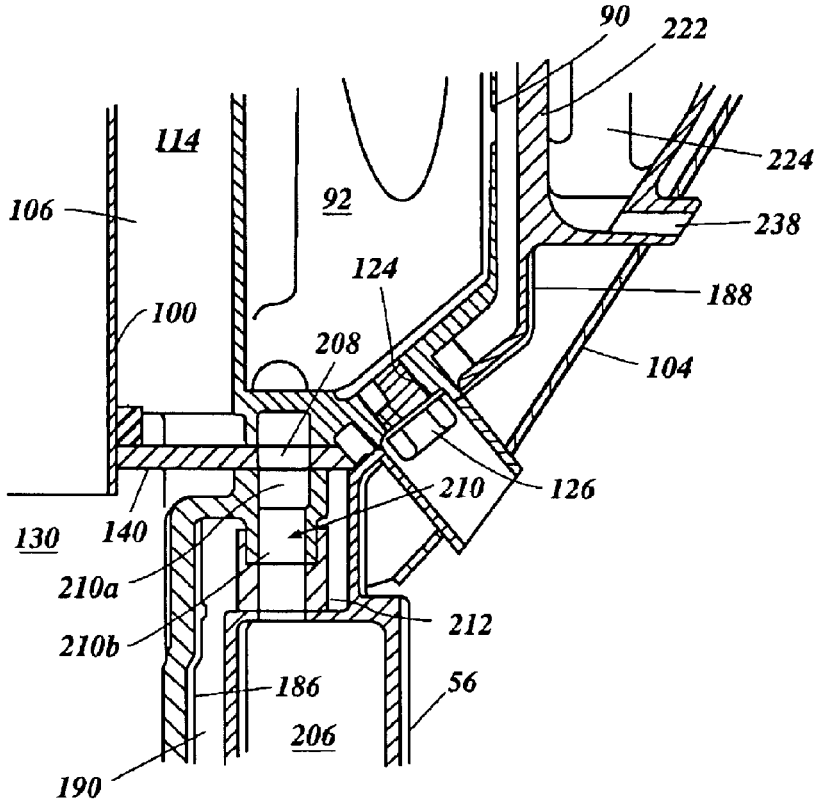
FIG. 3 is an enlarged side view of a portion of the outboard motor encircled by a phantom line 3 of FIG. 2.
Figure 4:
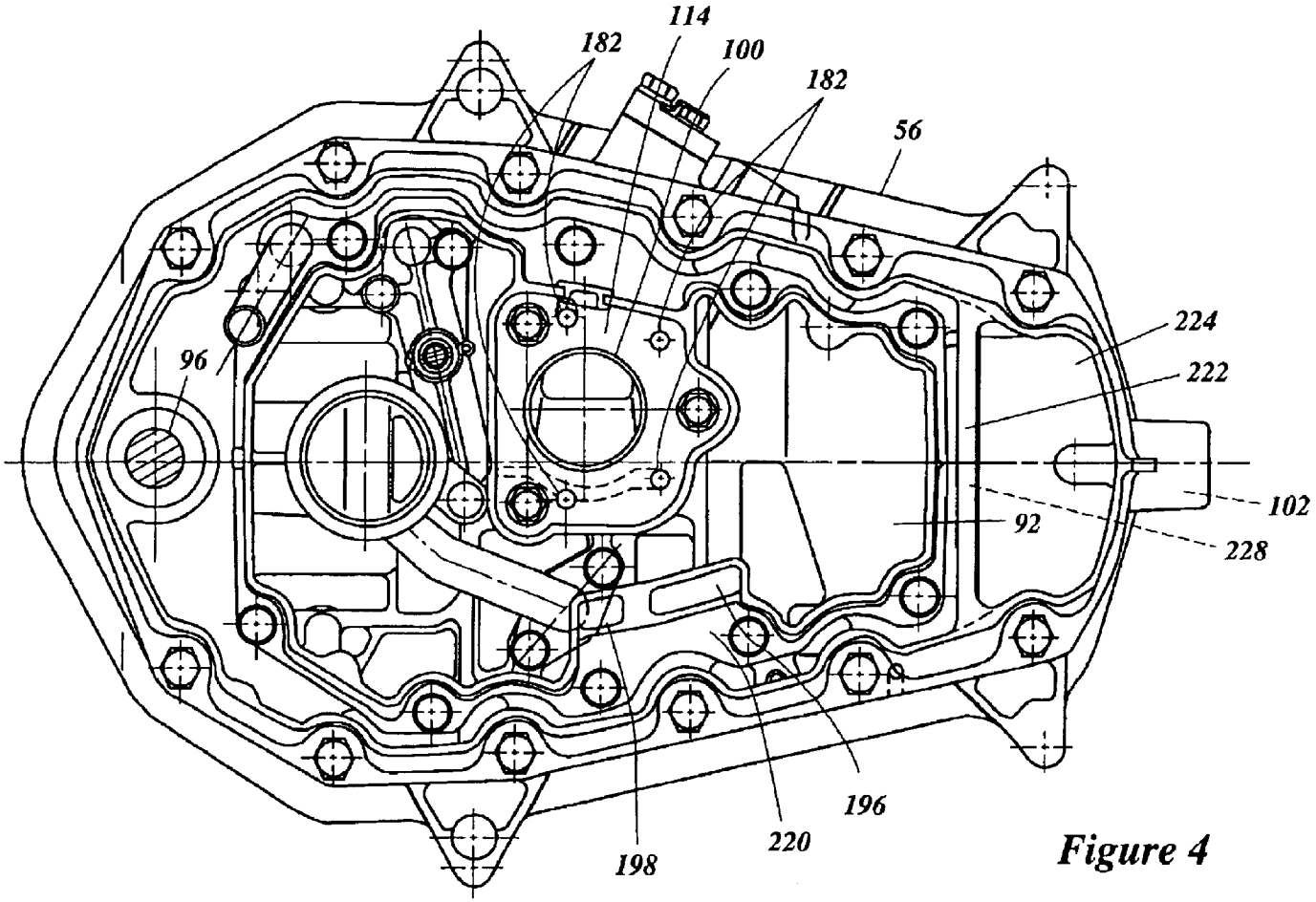
FIG. 4 is a sectional bottom plan view of the housing unit taken along the line 4—4 of FIG. 2.

With reference to FIGS. 2–4, the reservoir member 90 preferably depends from the exhaust guide member 72. The reservoir member 90 generally forms an annular recess that opens upwardly to define the lubricant reservoir 92. The reservoir member 90 also defines a reversed recess 106 that opens downwardly at a center of the annular recess. The reservoir member 90 is affixed to a bottom surface of the exhaust guide member 72 by bolts 108.

The exhaust conduit 100 extends through the downward recess 106 and has a flange that is affixed to the center portion of the reservoir member 90 in common with the reservoir member 90 by some of the bolts 108. The center portion of the reservoir member 90 defines an exhaust path 112 through which the exhaust passage 74 of the exhaust guide member 72 communicates with the exhaust passage defined by the exhaust conduit 100. The reservoir member 90 surrounds the exhaust conduit 100 and is radially spaced therefrom. An annular space 114 thus is formed between an inner surface of the downward recess 106 and an outer surface of the exhaust conduit 100.

A suction pipe 118 extends from a bottom portion of the lubricant reservoir 92 upwardly toward the lubricant passage within the engine body 78. An oil filter 120 is attached to the suction pipe 118 and is configured to remove foreign substances from the lubricant oil before passing through the suction pipe 118. An oil pump (not shown) preferably is coupled with the driveshaft 96 or the crankshaft to pressurize the lubricant from the section pipe 118 to the engine portions. As described above, the lubricant delivered to the engine 59 flows within the engine body 78 to lubricate the engine portions such as, for example, the crankshaft and the pistons. The lubricant that has lubricated the engine portions returns to the lubricant reservoir 92 by its own weight.

With particular reference to FIG. 3, a drain hole 124 is defined at a bottom of the reservoir member 90 to drain the lubricant in the reservoir 92 to a location outside of the outboard motor 30. Normally, a closure bolt 126 is fitted into the drain hole 124 to close the hole 124.

Figure 10:
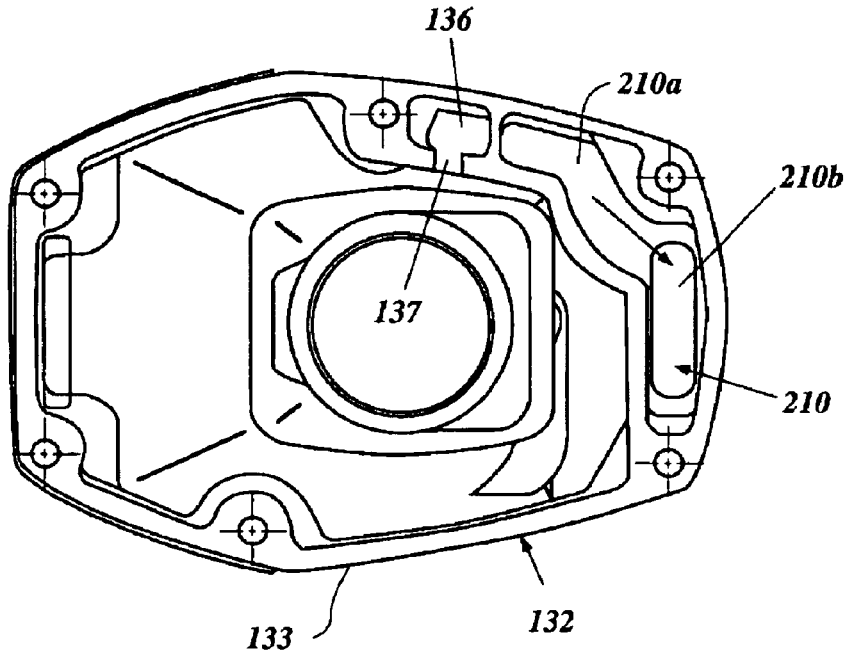
FIG. 10 is a top plan view of a second exhaust conduit of the outboard motor.

With reference to FIG. 2, a first expansion chamber 130 preferably is defined below the first exhaust conduit 100 in the driveshaft housing 56. In the illustrated arrangement, a second exhaust conduit 132, which is generally shaped as a jar, depends from a bottom of the reservoir member 90 to form the first expansion chamber 130 therein. The second exhaust conduit 132 has a top opening which has an inner diameter larger than an outer diameter of the exhaust conduit 100. A lowermost portion of the exhaust conduit 100 extends slightly into the expansion chamber 130. The top opening of the second exhaust conduit 132 is provided with a flange 133 (FIG. 10) and the second exhaust conduit 132 is affixed to the bottom of the reservoir member 90 with the flange 133 by bolts 134.

The second exhaust conduit 132 defines a recessed portion 136 of the idle exhaust section 101 at the flange 133. The first expansion chamber 130 communicates with the recessed portion 136 through a communicating port 137. The second exhaust conduit 132 tapers in girth toward a bottom thereof and is seated on a pedestal formed at an inner bottom portion of the driveshaft housing 56 via a seal member 138 (FIG. 2). The bottom of the second exhaust conduit 132 defines an opening that opens toward the lower unit 58.

Preferably, a partition 140 (FIGS. 2 and 3) generally separates the first expansion chamber 130 from the space 114 defined above the chamber 130. The partition 140 is affixed to the bottom of the reservoir member 90 together with the flange of the second exhaust conduit 132. The first exhaust conduit 100 is provided with a flange that abuts against the partition 140. A seal member 142 is interposed between the flange and the partition 140 to inhibit exhaust gases from moving to the space 114 from the first expansion chamber 130.

Figure 9:
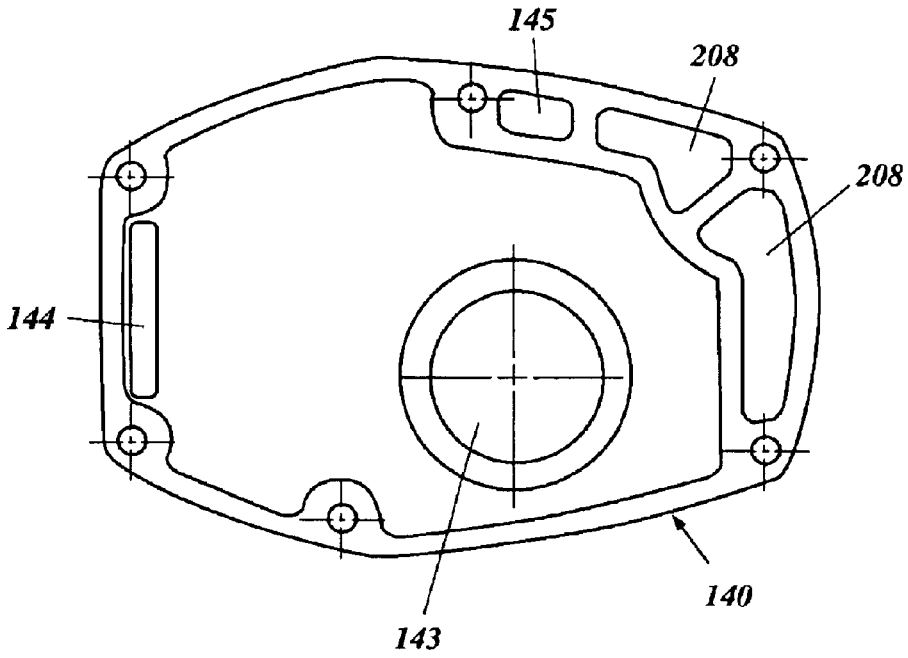
FIG. 9 is a top plan view of a partition of the outboard motor.

The partition 140 defines an aperture 143 (FIG. 9) through which the exhaust conduit 100 passes to the first expansion chamber 130. The partition 140 also defines another aperture 144 at a forward portion thereof and the first expansion chamber 130 communicates with the space 114 through the aperture 144. The partition 140 further defines an aperture 145 communicating with the recessed portion 136 of the second exhaust conduit 132.

With continued reference to FIG. 2, the lower unit 58 depends from the driveshaft housing 56 and supports a propulsion shaft 146, which is driven by the driveshaft 96. The propulsion shaft 146 extends generally horizontally through the lower unit 58. A propulsion device is attached to the propulsion shaft 146 to be driven by the propulsion shaft 146. In the illustrated arrangement, the propulsion device includes a propeller 148 affixed to an outer end of the propulsion shaft 146. More specifically, a hub 150 of the propeller 148 is mounted on the propulsion shaft 146 with a rubber damper 152. The propulsion device, however, can take the form of a dual counter-rotating system, a hydrodynamic jet, or any of a number of other suitable propulsion devices.

A transmission 156 preferably is provided between the driveshaft 96 and the propulsion shaft 146. The transmission 156 couples together the two shafts 96, 146 which lie generally normal to each other (i.e., at a 90° shaft angle) with bevel gears. The outboard motor 30 has a clutch mechanism that allows the transmission 156 to change the rotational direction of the propeller 148 among forward, neutral or reverse.

The lower unit 58 also defines a further internal passage of the exhaust system. A second expansion chamber 160 occupies major volume of the passage and is formed above a space where the propulsion shaft 146 extends. The second expansion chamber 160 is tapered downwardly like the first expansion chamber 130. The second expansion chamber 160 communicates with the first expansion chamber 130 and with an exhaust discharge path 162 defined at the hub 150 of the propeller 148.

At engine speeds above idle, the exhaust gases coming from the engine 59 descend the exhaust passage 74 of the exhaust guide member 72, the exhaust passage of the exhaust conduit 100, the first and second expansion chambers 130, 160 and then goes out to the body of water through the discharge path 162 of the propeller 148. Because the gases expand and contract twice within the first and second expansion chambers 130, 160, exhaust noise is advantageously attenuated.

At idle speed, the exhaust gases flow to the idle exhaust section 101 and are discharged through the idle discharge port 102. The difference in the locations of the discharges 162, 102 accounts for the differences in pressure at locations above the waterline and below the waterline. Because the opening above the waterline, i.e., the idle discharge port 102, is smaller, pressure develops within the lower unit 58. When the pressure exceeds the higher pressure found below the waterline, the exhaust gases exit through the hub 150 of the propeller 148. If the pressure remains below the pressure found below the waterline, the exhaust gases exit through the idle discharge section 101 above the waterline.

With reference to FIGS. 1–11, the cooling water transfer system 88 in the exhaust guide member 72 and the housing unit 54 is described below.

The lower unit 58 preferably forms a water inlet 166 at a side surface on the port side thereof. Alternatively, two water inlets can be formed, one on each side. A water delivery passage 168 is defined within the lower unit 58 and extends generally vertically along the driveshaft 96 from the water inlet 166 toward the bottom of the driveshaft housing 56. A water pump 170 is mounted on the driveshaft 96 at the bottom of the driveshaft housing 56 to be driven thereby and the water passage 168 is connected to the water pump 170. A water delivery conduit 172 extends generally vertically along the driveshaft 96 from the water pump 170 toward the engine 59. The water delivery conduit 172 is connected to the water jacket 86 of the engine body 78. The water jacket 86 is bifurcated at a bottom portion of the engine body 78 to define a branch water path 176 (FIG. 11) that goes toward the exhaust guide member 72.

Cooling water is taken from the body of water around the housing unit 54. The water is drawn through the water inlet 166. The water moves up through the water passage 168 to the water pump 170. The water pump 170 pressurizes the water to the water jacket 86 of the engine body 78 through the water delivery conduit 172. While a major part of the water travels through the water jacket 86 to cool the engine body 78, a small part of the water flows toward the exhaust guide member 72 through the branch water path 176.

Figure 5:
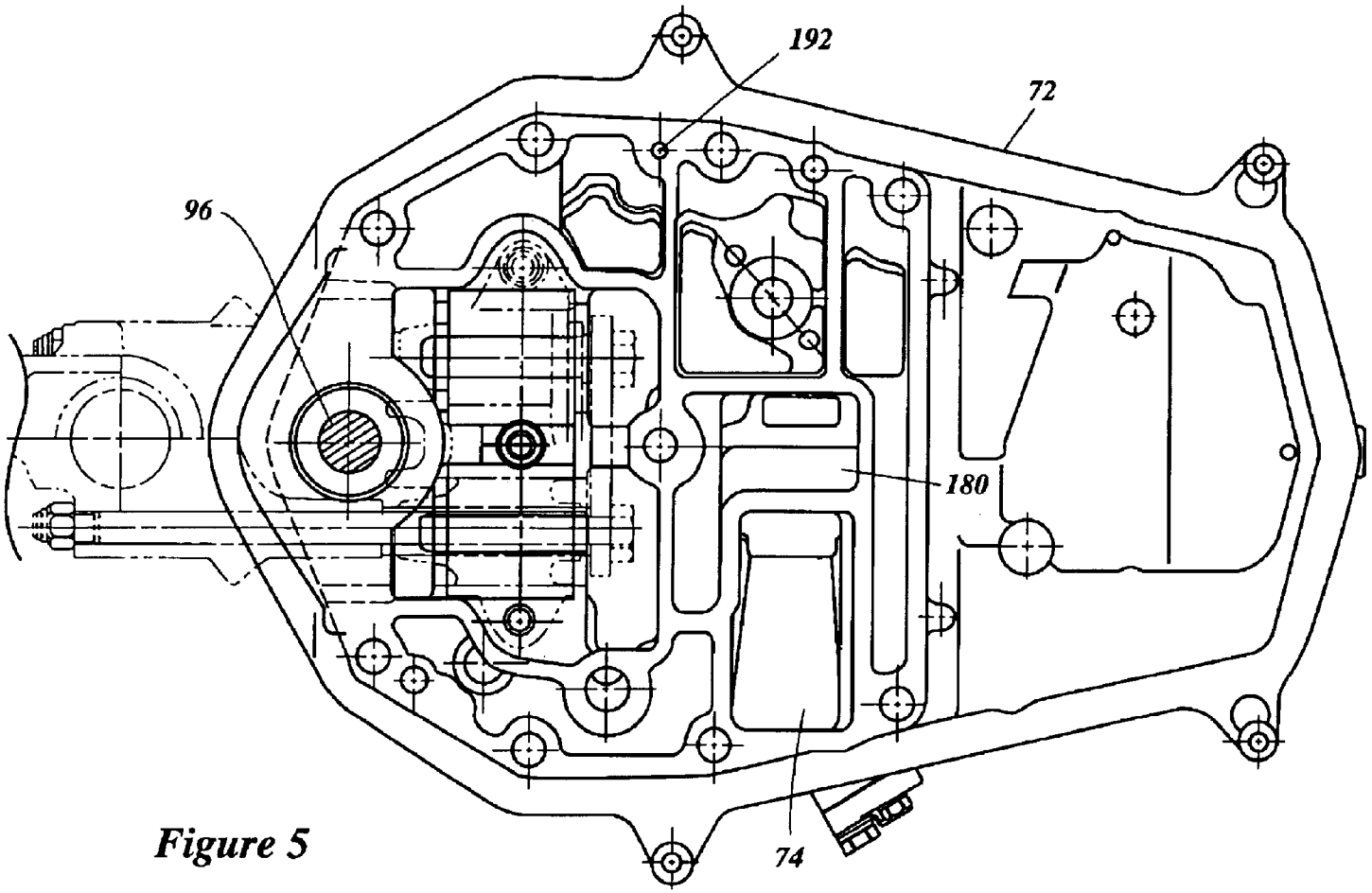
FIG. 5 is a top plan view of the exhaust guide member of FIG. 2.
Figure 6:
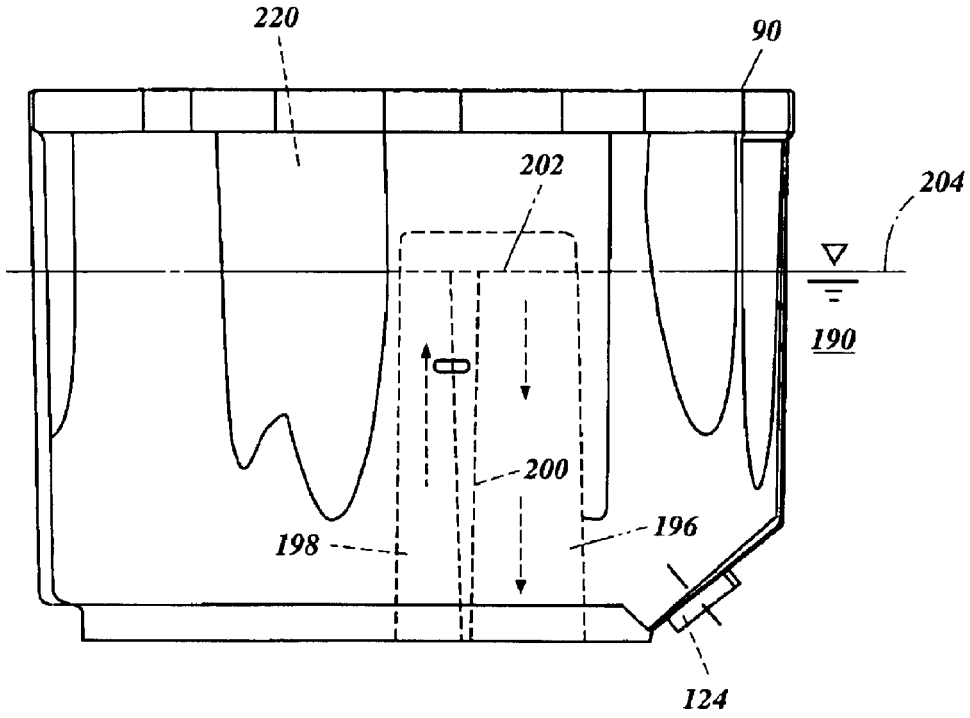
FIG. 6 is a side elevational view of a lubricant reservoir member of the outboard motor.
Figure 7:
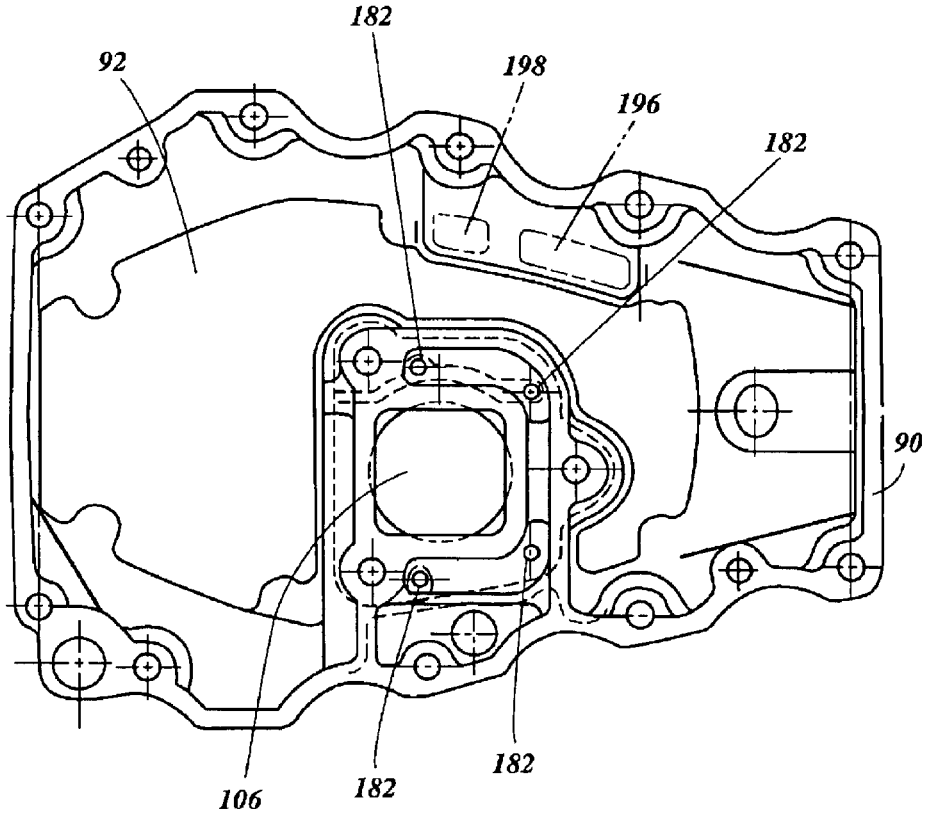
FIG. 7 is a top plan view of the lubricant reservoir member of FIG. 6.
Figure 8:
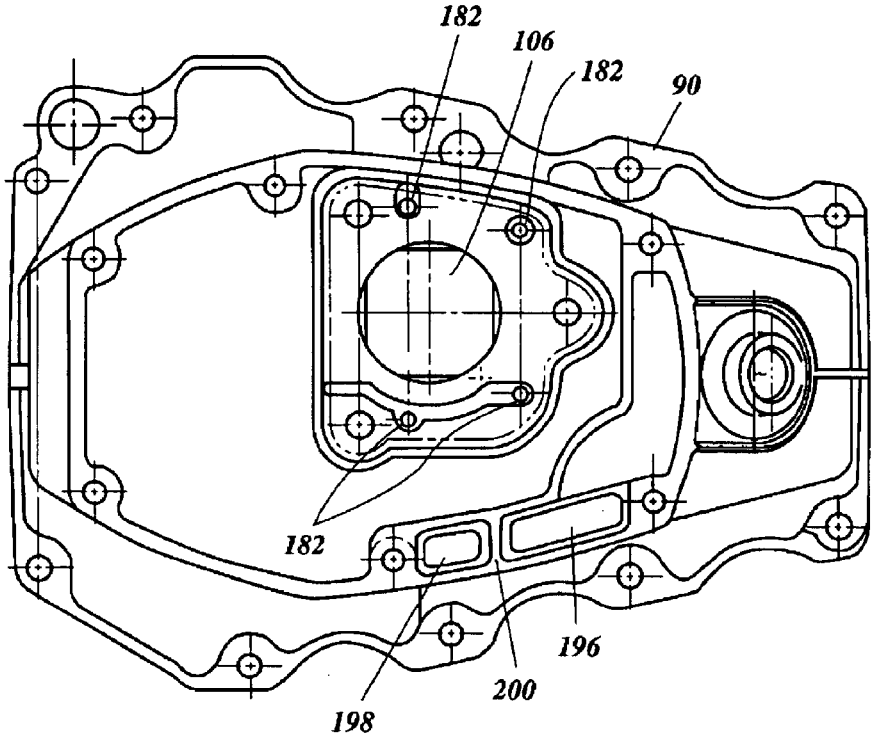
FIG. 8 is a bottom plan view of the lubricant reservoir member of FIG. 6.

The exhaust guide member 72 defines a water discharge passage 180 (FIGS. 2, 5 and 11) communicating with the water jacket 86. The water discharge passage 180 extends close to the exhaust passage 74 as shown in FIG. 5. The water that has traveled through the water jacket 86 and therefore is now heated, moves down through the water discharge passage 180.

The discharge passage 180 of the exhaust guide member 72 communicates with the space 114 through apertures 182 (FIGS. 4, 7 and 8) defined by the exhaust guide member 72 and the lubricant reservoir member 90. The water in the discharge passage 180 thus moves to the space 114 through the apertures 182 and flows down toward the partition 140 along an outer surface of the first exhaust conduit 100. Because the partition 140 generally separates the space 114 from the first expansion chamber 130, the water can accumulate within the space 114. The space 114 thus defines a first water pool. Because the partition 140 has the aperture 144, the water can gradually move to the first expansion chamber 130 through the aperture 144. The water then moves down through the first and second expansion chambers 130, 160 and exits to the body of water through the discharge path 162 of the propeller hub 150 with the exhaust gases.

In the illustrated arrangement, the water can cool the first exhaust conduit 100 when flowing down along the outer surface of the first exhaust conduit 100 and temporarily accumulating in the first water pool 114. The water also cools the lubricant reservoir member 90 at a portion that defines the reversed recess 106. Additionally, the water cools the second exhaust conduit 132 and the lower unit portion defining the first and second expansion chambers 130, 160, respectively, and then the propeller hub 150.

The propeller hub 150 carries the rubber damper 152 which can be deteriorated by heat. If the water did not pass through the discharge path 162, the rubber damper 152 might be heated by the exhaust gases passing through the discharge path. The water coming from the expansion chamber 160, however, passes through the discharge path 162 along with the exhaust gases in the illustrated arrangement. The rubber damper 152 thus is cooled appropriately with the water.

Additionally, the water that flows with the exhaust gases can contribute to reduce the exhaust noise because the water can lower an acoustic energy level of the exhaust gases.

With particular reference to FIGS. 2, 3 and 11, the driveshaft housing 56 preferably defines an internal wall 186 that surrounds the second exhaust conduit 132. The internal wall 186 merges with an outer wall 188 of the driveshaft housing 56 at a portion thereof generally surrounding the reservoir member 90. The internal wall 186 and the outer wall 188 together form a space or second water pool 190 around the first expansion chamber 130 and the reservoir member 90. The water in the branch water path 176 moves down to the space 190 through a hole 192 (FIGS. 5 and 11) defined in the exhaust guide member 72.

With continued reference to FIGS. 2, 3 and 11 and with additional reference to FIGS. 6–10, the reservoir member 90 preferably defines a water discharge path 196 and an idle exhaust path 198 (FIG. 6) on a side surface of the starboard side. The water discharge path 196 and the idle exhaust path 198 extend generally vertically and parallel to each other. A wall portion 200 (FIGS. 6 and 8) separates the idle exhaust path 198 from the water discharge path 196. The idle exhaust path 198 communicates with the aperture 145 of the partition 140. The water discharge path 196 defines a spillway or weir 202 atop thereof to regulate a water level 204 in the second water pool 190. The water discharge path 196 communicates with a water discharge guide 206 (FIGS. 2 and 3) formed between the internal wall 186 and the outer wall 188 of the driveshaft housing 56 through apertures 208 (FIGS. 2, 3 and 9) defined at the partition 140 and a connecting passage 210 (FIGS. 2 and 3). The connecting passage 210 comprises a recessed portion 210*a* defined next to the recessed portion 136 of the idle exhaust section 101 and an aperture 210*b*. Spilled water thus moves to the water discharge guide 206 through the water discharge path 196 on the lubricant reservoir member 90, the apertures 208 of the partition 140 and the connecting passage 210 defined by the second exhaust conduit 132. A lower portion of the connecting passage 210 preferably is formed with a rubber tube 212.

Proximate the bottom of the water discharge guide 206, the lower unit 58 defines several slots 214 (FIG. 2) on both side surfaces so that the water discharge guide 206 communicates with locations outside of the housing unit 54 therethrough. Alternatively, either the side surface on the port side or the starboard side may defined the slots 214. The water thus is discharged outside through the slots 214.

In the illustrated arrangement, the water in the branch water path 176 is a portion of water divided from the water flowing toward the water jacket 86. The water thus is fresh and relatively cold. Accordingly, the lubricant reservoir member 90 and the second exhaust conduit 132 surrounded by the water can be cooled adequately.

The water in the second water pool 190 around the lubricant reservoir member 90 directly contacts the outer wall 188 of the driveshaft housing 56. Also, the water in the second water pool 190 around the second exhaust conduit 132 isolates the water discharge guide 206 from the first expansion chamber 130. The water further flows through the water discharge guide 206 and along the outer wall 188. The outer wall 188 thus is always isolated from the hot water that has traveled around the engine body 78 and can be cooled with the relatively colder water which inhibits the outer wall 188 from becoming white. The appearance of the driveshaft housing 56 can thus be more easily maintained.

With particular reference to FIGS. 2–4, the idle exhaust path 198 communicates with an non-water area 220 which is defined by the driveshaft housing 56 and the lubricant reservoir member 90 above the second water pool 190. Thus, the idle exhaust path 198 flows over an upper surface of the water within the second water pool 190.

The non-water area 220 generally forms a circular expansion chamber that surrounds the lubricant reservoir member 90. That is, the non-water area 220 defines a cross-sectional flow area greater than that of the idle exhaust path 198 and thus defines a first idle expansion chamber. Thus, the upper surface of the water pooled in the second water pool 190 defines a lower surface of the first idle expansion chamber.

A vertical inner wall 222 (FIGS. 2 and 3) of the driveshaft housing 56 defines a second idle expansion chamber 224 together with the outer wall 188. Several incomplete partitions can be provided to define a labyrinth within the second idle expansion chamber 224. The vertical inner wall 222 terminates below the exhaust guide member 72 and thereby defines a slot 228 (FIGS. 2 and 4) through which the non-water area, i.e., the first idle expansion chamber 220 communicates with the second idle expansion chamber 224.

At idle speed, the exhaust gases from the first expansion chamber 130 flow into the idle exhaust section 101 because the back pressure caused by the body of water does not allow the exhaust gases exit through the exhaust discharge path 162 of the propeller hub 150. The exhaust gases move to the recessed portion 136 of the second exhaust conduit 132 through the communicating port 137. The exhaust gases then go up through the aperture 145 of the partition 140 (FIG. 9) to the idle exhaust path 198 of the lubricant reservoir member 90. The exhaust gases ascend the idle exhaust path 198 to the non-water area 220. The exhaust gases expands within the non-water area 220 to reduce part of exhaust energy thereof. The exhaust gases then move toward the second expansion chamber 224 and enter the chamber 224. Some of the exhaust gases may travel around the lubricant reservoir member 90 and then enter the second expansion chamber 224. The exhaust gases pass through the labyrinth within of the second expansion chamber 224 to further reduce the exhaust energy and then exit through the idle exhaust discharge port 102 to the atmosphere.

The idle exhaust gases can be accompanied by water. The illustrated driveshaft housing 56 defines a water drain 238 (FIGS. 2 and 3) at a bottom portion of the second expansion chamber 224. The water is separated from the idle exhaust gases by the labyrinth construction of the second expansion chamber 224 and is discharged outside. The water drain 238 also passes through the apron 104.

As thus described, in the illustrated arrangement, the idle exhaust gases firstly descend through the exhaust passage of the first exhaust conduit 100 to the first expansion chamber 130 and then ascend the idle exhaust path 198 of the lubricant reservoir member 90 to the non-water area 220. The idle exhaust gases thus travel far enough to lose exhaust energy. Accordingly, the exhaust noise is sufficiently reduced and the temperature of the exhaust gases falls to an appropriate level.

In the illustrated arrangement, the idle exhaust gases can expand and contract twice in the first and second idle expansion chambers 220, 224. The exhaust gases thus can lose significant exhaust energy.

In addition, the idle exhaust gases can flow along the cooling water on the lubricant reservoir member 90 in this arrangement. The construction is quite helpful to expedite removing the exhaust energy from the idle exhaust gases.

The lubricant reservoir member originally is prepared for the lubrication system. No special member is necessary to elongate the idle exhaust section. Production cost of the outboard motor thus can be greatly saved. Also, because of no special member is disposed, the driveshaft housing can be formed compact.

Of course, the foregoing description is that of a preferred construction having certain features, aspects and advantages in accordance with the present invention. For instance, the water that has traveled around the engine is not necessarily discharged with the exhaust gases. The hot water, for example, can be discharged through a passage separately made from the exhaust passage and spaced apart from the outer wall. Also, the partition is not necessarily provided in some arrangements. Accordingly, various changes and modifications may be made to the above-described arrangements without departing from the spirit and scope of the invention, as defined by the appended claims.

What is claimed is:

1. An outboard motor comprising a housing unit adapted to be mounted on an associated watercraft, the housing unit at least in part forming an outer wall exposed to the atmosphere, and an internal combustion engine disposed above the housing unit, the engine defining a coolant jacket through which engine coolant passes, the housing unit defining first and second coolant passages, the first coolant passage spaced apart from the outer wall, the first coolant passage communicating with the coolant jacket to allow the engine coolant to flow therethrough, the second coolant passage at least in part extending adjacent to the outer wall, and the second coolant passage not communicating with the coolant jacket and allowing coolant that has not passed through the coolant jacket to flow therethrough.

2. The outboard motor as set forth in claim 1, wherein the housing unit defines first and second coolant discharge ports disposed separately from each other, the first coolant passage communicating with the first coolant discharge port, and the second coolant passage communicating with the second coolant discharge port.

3. The outboard motor as set forth in claim 2, wherein the housing unit defines an internal exhaust passage communicating with an exhaust port of the engine to discharge exhaust gases from the engine, the first coolant passage at least in part defined in common with the exhaust passage.

4. The outboard motor as set forth in claim 3 additionally comprising a propeller to thrust the housing unit, the propeller defining an exhaust path communicating with the exhaust passage, the exhaust gases being discharged to a location out of the housing unit through the exhaust path, and the exhaust path defining the first coolant discharge port.

5. The outboard motor as set forth in claim 4 additionally comprising at least one shaft driven by the engine, a hub of the propeller being supported by the shaft via a rubber damper.

6. The outboard motor as set forth in claim 1, wherein the housing unit defines an internal exhaust passage communicating with an exhaust port of the engine, the first coolant passage at least in part defined in common with the exhaust passage.

7. The outboard motor as set forth in claim 6, wherein the exhaust passage comprises an exhaust conduit disposed below the engine, the engine coolant flowing along an outer surface of the exhaust conduit.

8. The outboard motor as set forth in claim 7 additionally comprises a second exhaust conduit disposed below the first exhaust conduit, the engine coolant flowing within the second exhaust conduit.

9. The outboard motor as set forth in claim 6, wherein the exhaust passage comprises an exhaust conduit disposed below the engine, the housing unit forming an internal wall surrounding at least a portion of the exhaust conduit to define a coolant pool as a portion of the second coolant passage, and the coolant that has not passed through the coolant jacket temporarily accumulating in the coolant pool.

10. The outboard motor as set forth in claim 9, wherein a second portion of the second coolant passage extends between the inner wall and the outer wall, the second portion of the second coolant passage communicating with the first portion of the second coolant passage at a weir of the coolant pool so that the wall coolant spilled from the first portion of the second coolant passage flows into the second portion of the second coolant passage.

11. The outboard motor as set forth in claim 6, wherein the exhaust passage comprises a first exhaust conduit disposed below the engine, and a second exhaust conduit disposed below the first exhaust conduit, an inner diameter of the second exhaust conduit being larger than an outer diameter of the first exhaust conduit, the engine coolant flowing along an outer surface of the exhaust conduit and flowing within the second exhaust conduit.

12. The outboard motor as set forth in claim 1 additionally comprising a lubricant reservoir member disposed below the engine to define a lubricant reservoir therein, the engine defining a lubricant passage communicating with the lubricant reservoir, the housing unit defining an internal exhaust passage communicating with an exhaust port of the engine, the exhaust passage comprising at least one exhaust conduit disposed below the engine and surrounded by the lubricant reservoir member, and the first coolant passage at least in part being formed in a space defined between the lubricant reservoir member and the exhaust conduit.

13. The outboard motor as set forth in claim 12, wherein the exhaust passage additionally comprising a second exhaust conduit disposed below the first exhaust conduit, both the first exhaust conduit and the space communicating with the second exhaust conduit.

14. An outboard motor comprising a housing unit adapted to be mounted on an associated watercraft, the housing unit at least in part forming an outer wall exposed to the atmosphere, an internal combustion engine disposed above the housing unit, the engine defining a water jacket, and a water transfer system arranged to introduce water from outside of the housing unit, to deliver the water to the water jacket and to discharge the water to a location out of the housing unit, the water transfer system including first and second water passages defined within the housing unit, the first water passage communicating with the water jacket, the second water passage not communicating with the water jacket, the water transfer system delivering a portion of the water to the second water passage upstream of the water jacket, the second water passage at least in part extending between the first water passage and the outer wall.

15. The outboard motor as set forth in claim 14, wherein the housing unit defines an internal exhaust passage communicating with an exhaust port of the engine to discharge exhaust gases from the engine to a location out of the housing unit, and the first water passage at least in part defined in common with the exhaust passage.

16. The outboard motor as set forth in claim 15, wherein the housing unit defines a water discharge port of the second water passage and an exhaust discharge port of the exhaust passage, the water discharge port spaced apart from the exhaust discharge port.

17. An outboard motor comprising a housing unit adapted to be mounted on an associated watercraft, the housing unit at least in part forming an outer wall exposed to the atmosphere, an internal combustion engine disposed above the housing unit, the engine defining a coolant jacket, the housing unit defining an internal exhaust passage communicating with an exhaust port of the engine to discharge exhaust gases from the engine to a location out of the housing unit, and means for preventing calcium adhered to the outer wall from being whitened by fresh coolant that has not passed through the coolant jacket.

18. An outboard motor comprising a housing unit adapted to be mounted on an associated watercraft, the housing unit at least in part forming an outer wall exposed to the atmosphere, an internal combustion engine disposed above the housing unit, the engine defining a coolant jacket, the housing unit defining an internal exhaust passage communicating with an exhaust port of the engine to discharge exhaust gases from the engine to a location out of the housing unit, means for preventing calcium adhered to the outer wall from being whitened, and a propeller to thrust the housing unit, the propeller defining an exhaust path communicating with the exhaust passage, the exhaust gases being discharged to a location out of the housing unit through the exhaust path, and the exhaust path defining a coolant discharge port.

19. An outboard motor comprising a housing unit adapted to be mounted on an associated watercraft, the housing unit at least in part forming an outer wall exposed to the atmosphere, an internal combustion engine disposed above the housing unit, the engine defining a coolant jacket, the housing unit defining an internal exhaust passage communicating with an exhaust port of the engine to discharge exhaust gases from the engine to a location out of the housing unit, the exhaust passage comprising an exhaust conduit disposed below the engine, the housing unit forming an internal wall surrounding at least a portion of the exhaust conduit to define a coolant pool, and means for preventing calcium adhered to the outer wall from being whitened.

20. An outboard motor comprising a housing unit adapted to be mounted on an associated watercraft, the housing unit at least in part forming an outer wall exposed to the atmosphere, an internal combustion engine disposed above the housing unit, the engine defining a coolant jacket, the housing unit defining an internal exhaust passage communicating with an exhaust port of the engine to discharge exhaust gases from the engine to a location out of the housing unit, the exhaust passage including a first exhaust conduit disposed below the engine, and a second exhaust conduit disposed below the first exhaust conduit, an inner diameter of the second exhaust conduit being larger than an outer diameter of the first exhaust conduit, a cooling system configured to guide coolant along an outer surface of the exhaust conduit and through the second exhaust conduit, and means for preventing calcium adhered to the outer wall from being whitened.

21. An outboard motor comprising a housing unit adapted to be mounted on an associated watercraft, the housing unit at least in part forming an outer wall exposed to the atmosphere, and an internal combustion engine disposed above the housing unit, the engine defining a coolant jacket through which engine coolant passes, the housing unit defining first and second coolant passages, the first coolant passage spaced apart from the outer wall, the first coolant passage delivering the engine coolant to the coolant jacket, the second coolant passage at least in part extending adjacent to the outer wall, and the second coolant passage allowing only coolant that has not passed through the coolant jacket to flow therethrough.

22. The outboard motor as set forth in claim 21, wherein the second coolant passage is branched away from the first coolant passage upstream of the coolant jacket.

23. An outboard motor comprising a housing unit adapted to be mounted on an associated watercraft, the housing unit at least in part forming an outer wall exposed to the atmosphere, and an internal combustion engine disposed above the housing unit, the engine defining a coolant jacket through which engine coolant passes, first and second coolant passages disposed below the engine, the first coolant passage spaced apart from the outer wall, the first coolant passage delivering the engine coolant to the coolant jacket, the second coolant passage at least in part extending adjacent to the outer wall, and the second coolant passage not allowing coolant that has passed through the coolant jacket to flow therethrough.

24. A method of preventing calcium whitening on an exterior wall of an outboard motor, comprising introducing water into a water jacket of an engine of the outboard motor to cool the engine, branching away a portion of the water upstream of the water jacket, and delivering the portion of the water to flow at least adjacent an interior portion of the exterior wall to cool at least a portion of the wall.

* * * * *